United States Patent [19]

Salas

[11] Patent Number: 4,480,394

[45] Date of Patent: Nov. 6, 1984

[54] DRYER FOR SAFETY RAZOR

[76] Inventor: Edelmiro A. Salas, Temple E-18, Santa Ana, Río Piedras, P.R. 00927

[21] Appl. No.: 479,907

[22] Filed: Mar. 29, 1983

[51] Int. Cl.[3] ..... F26B 9/06

[52] U.S. Cl. ..... 34/202; 219/227; 219/240; 219/242; 219/518

[58] Field of Search ..... 34/104, 202; 219/221, 219/227, 240, 242, 419, 518

[56] References Cited

U.S. PATENT DOCUMENTS

| | | | |
|---|---|---|---|
| 1,595,440 | 8/1926 | Winslow | 34/202 |
| 3,637,982 | 1/1972 | Reaves | 34/202 |
| 3,786,576 | 1/1974 | Gavlick, Sr. | 34/104 |
| 4,241,290 | 12/1980 | Folland | 34/202 |
| 4,250,630 | 2/1981 | Moses | 34/104 |

*Primary Examiner*—Larry I. Schwartz

*Attorney, Agent, or Firm*—Scrivener, Clarke, Scrivener and Johnson

[57] ABSTRACT

A box is provided with an opening in its top for receiving the blade-holding head of a safety razor with the end of the handle of the razor resting on the surface supporting the box. Means within the box directs heated air onto the head of the razor within the opening in the top of the box.

1 Claim, 4 Drawing Figures

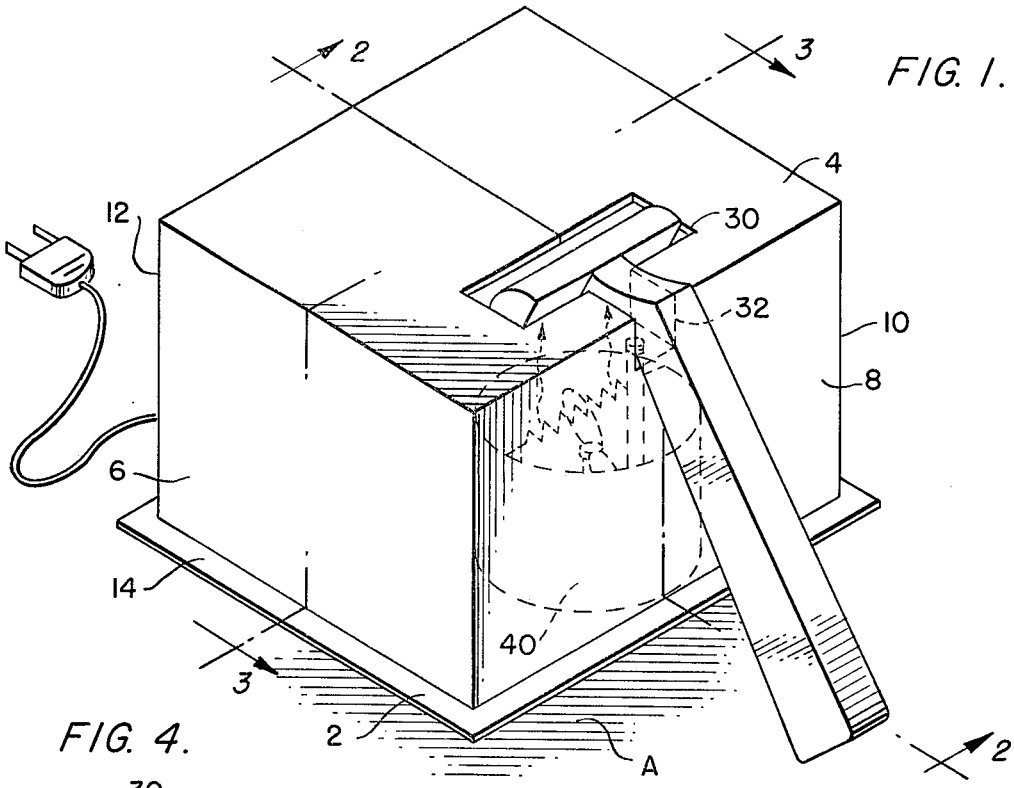
FIG. 1.
FIG. 4.
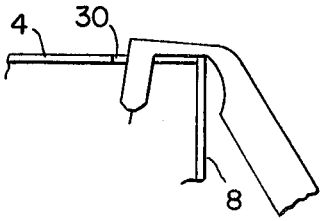
FIG. 3.
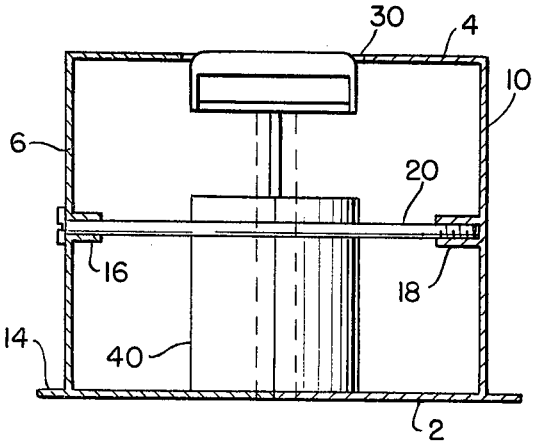
FIG. 2.
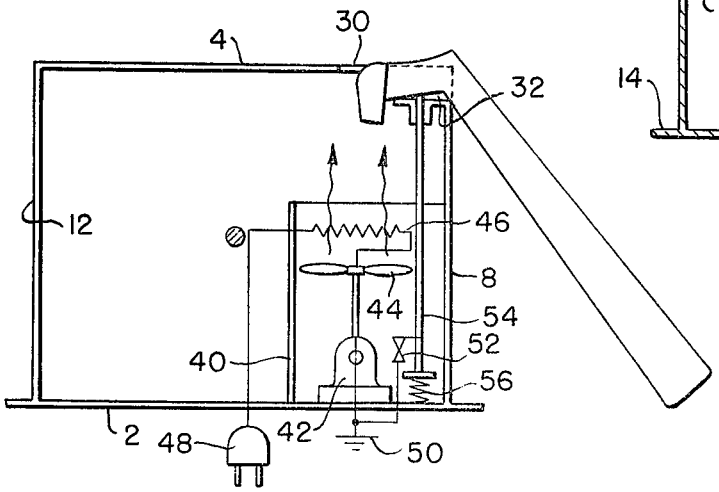

DRYER FOR SAFETY RAZOR

SUMMARY OF THE INVENTION

A box has an opening in its top surface for receiving the blade holding part of a safety razor with the end of its handle resting on the surface holding the box. Means are provided within the box and beneath the opening for directing heated air upwardly onto the blade holding part of the razor which is within the opening.

DESCRIPTION OF THE DRAWINGS

FIG. 1 is a perspective view of the razor blade drying device provided by the invention, showing a safety razor in operative position with the device;

FIGS. 2 and 3 are, respectively, sectional views taken on lines 2—2 and 3—3 of FIG. 1, and FIG. 4 is a partial view illustrating a modified form of the razor drying device.

DESCRIPTION OF THE PREFERRED EMBODIMENT OF THE INVENTION

The invention provides a device for drying the head of a safety razor of the type having a head for receiving and holding a razor blade and an elongated handle extending from the head. Although the device is useful for drying the head and blade of any razor of the described type it will be found to be particularly useful with the disposable safety razors which have recently been introduced to the market.

The preferred embodiment of the invention comprises a hollow parallelopiped, hereinafter referred to as a box, having a bottom 2, top 4 and side walls 6, 8, 10, 12. The bottom preferably extends beyond all of the side walls, as shown at 14, to provide a secure base for the device on surface A. The box is preferably formed of two identical halves and the parallel side walls 6, 10 are therefore provided with internally screw threaded bosses 16, 18 for the reception of a headed and threaded screw 20 by which the two parts of the box may be connected to form a unitary device. If desired the bottom of the box may be made separate from the side walls to facilitate the installation of parts within the box, and the bottom may be connected to the side walls by screws if this construction is adopted.

Means are provided for receiving the blade holding head of a safety razor in position to be exposed to the interior of the box, and such means comprise an opening 30 in the top 4 which is positioned adjacent side wall 8 and is elongated in the direction parallel to that side wall, and is of a size and configuration to receive the blade side of the head of a safety razor with the blade directed downwardly into the interior of the box. A second opening 32 is formed in the top 4 and the upper part of side wall 8 and is positioned midway the length of opening 30 and communicates with the opening. This second opening is provided to accomodate the upper part of the handle of a razor the head of which is positioned within the opening 30 and which, without opening 32 would rest on the corner edge between side wall 8 and top 4.

The side walls of the box are of such height that when the end of the handle of a normal safety razor is rested on the surface A which supports the box the blade part of the head will be received within the opening 30 in the described position and the upper part of the handle will rest in the opening 32.

Means are provided within the box for directing heated air upwardly onto the razor head positioned within the opening 30, and such means comprise, first, a cylindrical wall 40 which rests on the bottom 2 at a position within the box directly under the opening 30 in the top of the box, and which is open at its upper end. Within the cylinder and resting on the bottom 2 is a motor 42 which drives a fan 44 which is positioned above the motor and is constructed and operable to direct a stream of air upwardly from the cylinder to the razor head receiving opening 30. Positioned above the fan and in the path of the upwardly moving air stream is a heating coil 46. An electric circuit including a source of power 48, ground 50 and switch 52 is provided to energize the motor and heating coil. The switch may be automatically operated, and for this purpose there is provided an elongated rod 54 which is connected to the movable contact of switch 52 and at its lower end rests on spring 56 which normally maintains the switch open. The upper end of the rod is positioned within the opening 30, 32 so that when a razor is positioned in operative position with the device the rod will be pushed downwardly to close the switch.

In the use of the device a safety razor, immediately after use and while still wet, will be positioned with the free end of its handle on the surface A, which supports the box, and will be leaned against the box with the head end of the handle within the corner opening 32 and the razor head within the opening 30 in the top with the razor blade within the box. The motor and heating coil may now be operated by depression of rod 54 to close the switch 52 to direct a stream of heated air upwardly onto the razor blade and head to dry them.

If the upper end of the handle of a safety razor is of minimum thickness the second opening 32 in the top 4 and the side wall 8 will not be required and may be omitted, as shown in FIG. 4.

I claim:

1. A device for drying the head of safety razor, comprising a hollow box of rectangular parallelopiped shape adapted to rest with its bottom on a flat supporting surface with its side wall extending upwardly at right angles to the supporting surface and supporting a flat upper surface of the box, the upper surface of the box having an elongated opening adjacent and parallel to one side wall which is of a shape and size to receive the razor edge part of the head of a safety razor, the side walls of the box being of such uniform height that the razor blade end of a safety razor standing with the free end of its handle on the supporting surface is received within the opening, and means within the box and below the opening in the upper surface for directing a stream of hot air upwardly onto the razor blade head within the opening.

* * * * *